US005447480A

United States Patent [19]

Fulks

[11] Patent Number: 5,447,480

[45] Date of Patent: Sep. 5, 1995

[54] WEIGHT LIFTING MACHINE

[76] Inventor: Kent Fulks, 9710 Amberly Dr., Dallas, Tex. 75243

[21] Appl. No.: 34,734

[22] Filed: Mar. 19, 1993

[51] Int. Cl.[6] ..... A63B 21/06

[52] U.S. Cl. ..... 482/99; 482/100; 482/133; 482/137; 482/138

[58] Field of Search ..... 482/97–103, 482/130, 133–138, 142, 908

[56] References Cited

U.S. PATENT DOCUMENTS

| | | | |
|---|---|---|---|
| 4,600,189 | 7/1986 | Olschansky et al. | 482/100 |
| 4,629,185 | 12/1986 | Amann | 482/133 X |
| 4,666,149 | 5/1987 | Olschansky et al. | 482/130 |
| 4,711,448 | 12/1987 | Minkow et al. | 482/100 |
| 4,721,303 | 1/1988 | Fitzpatrick | 482/103 |
| 4,744,559 | 5/1988 | Mahnke et al. . | |
| 4,746,115 | 5/1988 | Lahman . | |
| 4,765,615 | 8/1988 | Case | 482/908 X |
| 4,768,775 | 9/1988 | Marshall | 482/908 X |
| 4,809,972 | 3/1989 | Rasmussen et al. . | |
| 4,902,006 | 2/1990 | Stallings, Jr. | 482/99 |
| 4,915,377 | 4/1990 | Malnke et al. . | |
| 4,930,768 | 6/1990 | Lapcevic . | |
| 4,964,632 | 10/1990 | Rockwell . | |
| 4,982,955 | 1/1991 | Heasley . | |
| 4,982,956 | 1/1991 | Lapcevic . | |
| 4,986,538 | 1/1991 | Ish, III . | |
| 4,988,095 | 1/1991 | Ferrari . | |
| 5,074,551 | 12/1991 | Olschansky et al. | 482/137 |
| 5,209,223 | 5/1993 | McGorry et al. | 482/142 X |
| 5,236,406 | 8/1993 | Webber | 482/100 |

*Primary Examiner*—Richard J. Apley
*Assistant Examiner*—John Mulcahy
*Attorney, Agent, or Firm*—Michael A. O'Neil; Kay Lyn Schwartz

[57] ABSTRACT

A weight lifting machine for performing a wide range of exercises, has a lift bar angularly adjustable for a starting lift position angularly upward or downward of a substantially horizontal position. An actuating bar is connected to the lift bar for movement therewith. First and second pulleys are movably mounted above and below the actuating bar such that the first pulley moves upwardly with the actuating bar and the second pulley moves downwardly with the actuating bar. The first pulley is prevented from moving downwardly when the second pulley is moved downwardly with the actuating bar and the second pulley is likewise prevented from moving upwardly when the first pulley is moved upwardly. A lift cable is threaded through the first and second pulleys such that movement of the lift bar in either direction lengthens the distance between the pulleys, thereby lifting a plate-type weight stack. The machine is also equipped with butterfly bars and a leg extension, with the lift bar, butterfly bars and leg extension all connected to the weight stack through a single lift cable.

16 Claims, 11 Drawing Sheets

WEIGHT LIFTING MACHINE

TECHNICAL FIELD

This invention relates generally to weight lifting machines, and more particularly to a weight lifting machine configured to allow a wide variety of exercises using a single weight stack, and a single lift cable with consistent resistance applied thereto.

BACKGROUND OF THE INVENTION

With the advent of the physical fitness boom, weight lifting machines of all shapes and sizes appeared on the market. Unfortunately, each machine typically provides for a very limited range of exercises, requiring several machines to accomplish a full workout.

Various means of resistance have been employed in the many different types of weight lifting machines. Hydraulic and pneumatic resistance, as well as cable supported lead weight resistance have been employed, with the traditional lead weight resistance machines exhibiting greater durability. Due to the fact that the weight stack is suspended from a cable for incrementally adjusting the amount of weight being lifted, the range of exercises available has been limited by the configuration of the lift cable. Typically, the cable is configured for extension and retraction in a single direction over a series of pulleys. Therefore, movement of the weight lifting bar or lever connected to the opposed end of the lift cable is restricted to a particular range or direction of movement, thereby requiring several different machines to complete a full body workout.

SUMMARY OF THE INVENTION

The weight lifting machine of the present invention overcomes the foregoing limitations and restrictions by providing a lift cable attached to the weight stack and configured through a series of pulleys for directional movement of the cable while maintaining consistent tension for lifting the weight stack through a variety of ranges and from a variety of directions to allow for a more complete workout using the single weight stack.

A lift bar is pivotally mounted to the frame and adjustably connected to a curved member for upward or downward positioning of the lift bar. The curved member is attached to a pivot arm mounted for pivotal movement between parallel upper and lower restraining arms having pulleys mounted thereon for guiding the movement of the cable and maintaining constant resistance. The restraining arms allow movement in the direction of one arm at a time, yet are anchored to limit pivotal movement toward the other arm, resulting in constant tension on the lift cable, to provide a more controlled workout.

In one embodiment of the weight lifting machine, a second series of pulleys allows the single lift cable to be attached to a second weight lifting station for lifting the weights from the single weight stack through a leg extension bar and two separately pivoting butterfly bars.

A moveable bench is mounted for positioning on a track under the weight lifting bar. The bench may be moved horizontally along the track such that the area immediately below the weight lifting bar is clear to allow the weight lifter to perform standing exercises such as squats, shrugs, and calf extensions. The back of the bench is angularly positionable in relation to the seat to provide a variety of reclining angles in relation to the lift bar. The bench may also be pivoted about a vertically extending axis to allow lifting of the bar in a generally rearward position, or the bench may be rotated 180° to allow the bar to be lifted in a generally forward position in relation to the person exercising.

The expanded range of motion provided by the curved member for adjusting the angle of the lift bar, the cable configuration for the first and second stations, as well as the multi-position bench allow an exerciser to complete a full body workout in a limited space using a single machine having a single weight stack, and a single lift cable against which consistent tension is maintained.

BRIEF DESCRIPTION OF THE DRAWINGS

For a more complete understanding of the present invention and the advantages thereof, reference is now made to the following Detailed Description taken in conjunction with the accompanying Drawings, in which.

DETAILED DESCRIPTION

Figure 1:
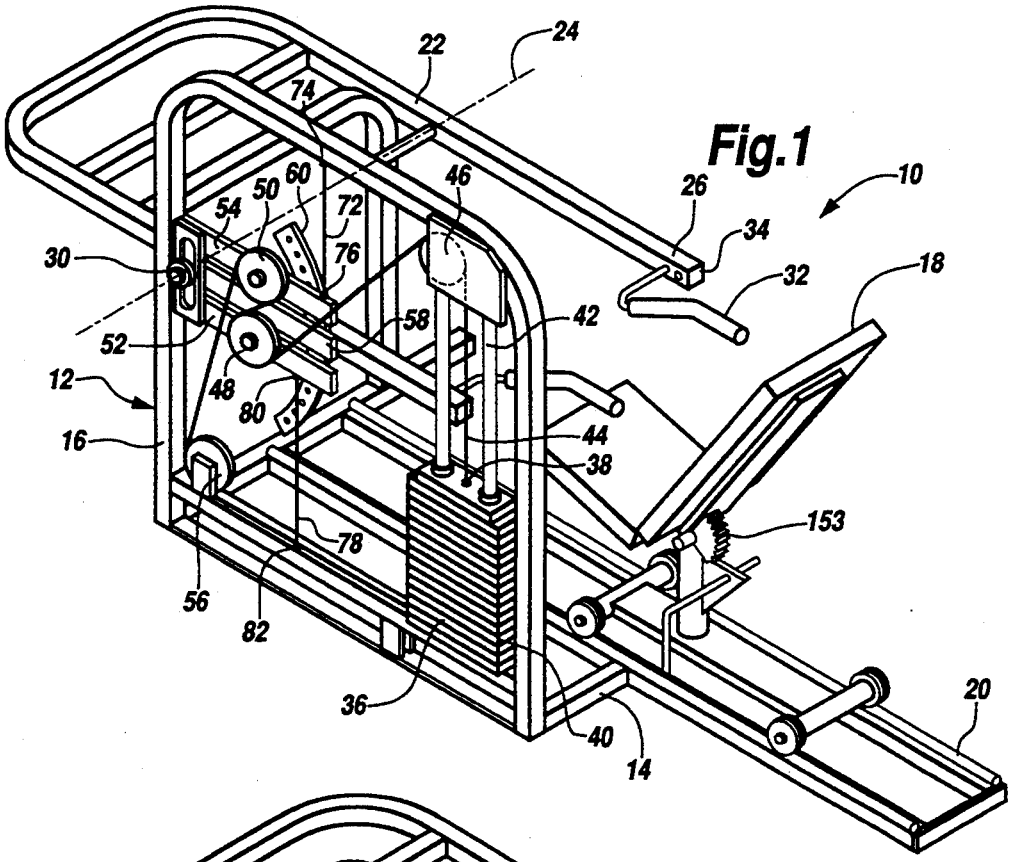
FIG. 1 is a perspective view of a single station weight lifting machine incorporating a first embodiment of the present invention.
Figure 2:
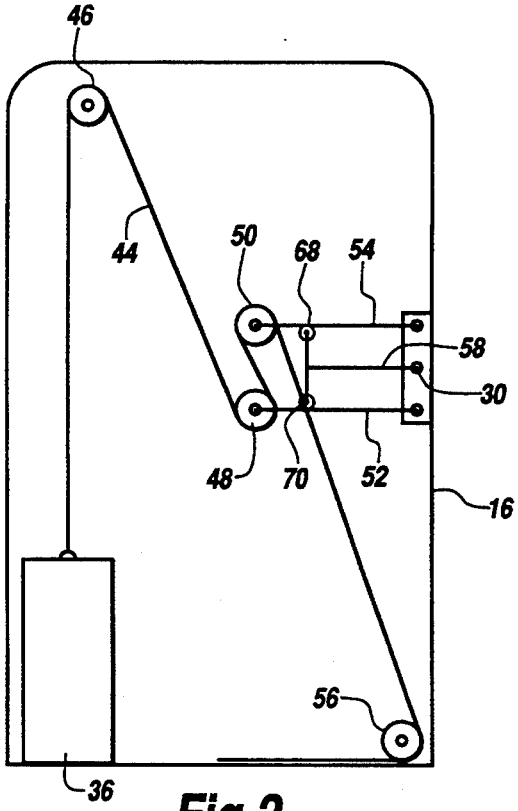
FIG. 2 is a schematic diagram of the pulley and lift cable configuration of the weight lifting machine of FIG. 1.

Referring now to the Drawings and more particularly to FIGS. 1 and 2 thereof, there is shown a weight-lifting machine 10 incorporating a first embodiment of the present invention. A main support frame 12 has a base frame 14 connected to a vertically extending weight support frame 16. A bench 18 is mounted for horizontal movement along a track 20 connected to the base frame 14. Pivotally mounted to the weight support frame 16 is a lift apparatus 22, mounted for rotation about an axis 24 extending in a generally horizontal orientation and perpendicular to the weight support frame 16.

The lift apparatus 22 has a first end 26 extending over the bench track 20 and a second end 28 extending beyond the pivotal attachment point 30 to the weight support frame 16. Lift handles 32 are mounted in the first end 26 of the lift apparatus 22 for gripping by an exerciser to pivot the lift apparatus 22 about the axis 24. Openings 34 in the first end 26 of the lift apparatus 22 allow the insertion of alternative forms of lift bars and handles for performing exercises such as squats. A weight stack 36 is mounted on the weight support frame 16 and is preferably a conventional plate type stack, having a selector rod 38 extending vertically through a stack of individual plates 40 of varying weight and a carriage 42 for vertical movement of a selected number of the plates 40.

A lift cable 44 is connected to the selector rod 38 and passes over a lift pulley 46 mounted to the weight support frame 16 for rotational movement at a point above the weight stack 36 such that the cable 44 moves in a generally vertical path from the weight stack 36 over the lift pulley 46. The lift cable 44 then passes over a pair of resistance pulleys 48 and 50 mounted for rotation on pivotal arms 52 and 54, respectively. The lift cable 44 then passes around anchor pulley 56 and is fixedly attached to the weight support frame 16 at a point beyond the anchor pulley 56.

Mounted at pivotal attachment point 30 for pivotal movement between pivotal arms 52 and 54 is a support arm 58, having an apertured arc member 60 mounted thereon. Referring now to FIGS. 1, 2, 3, and 6, the apertured arc member 60 has a first side 62 which faces the pivotal support arm 58 and a second side 64 facing the lift apparatus 22. The arc member 60 is fixedly mounted at an approximate center point 66 to the support arm 58. Mounted for rotation on the first side 62 of the arc member 60, such that the pivotal support arm 58 extends therebetween, are two wheel members 68 and 70. A restraining cable 72 is connected to the weight support frame 16 at a point 74, above the pivotal arm 54 and is attached to pivotal arm 54 at a point 76 near the distal end of the pivotal arm 54 to restrain downward pivotal movement of pivotal arm 54. A similar restraining cable 78 is attached pivotal arm 52 at attachment point 80 and extends downwardly therefrom for attachment to the weight support frame 16 at attachment point 82, to restrict upward pivotal movement of pivotal arm 52.

Figure 4:
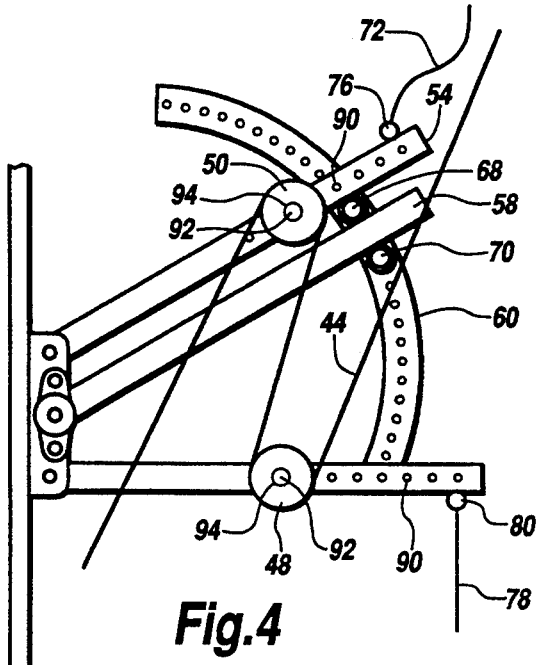
FIG. 4 is a side view similar to FIG. 3, illustrating upward movement of the lift bar.

Referring now to FIGS. 1, 4, 5, and 6, the lift apparatus 22 is adjustably connected to the arc member 60 by a pin 84 inserted through an opening 86 in the lift apparatus 22 and into any one of the apertures 88 of the arc member 60. Thus, once a desired lift angle is selected and set by inserting the pin 84 through the opening 86 in the lift apparatus 22 and into an aperture 88 in the arc member 60, movement of the lift apparatus 22 in an upward direction causes the wheel member 68 to rotatively contact pivotal arm 54 forcing pivotal arm 54 and resistance pulley 50 in an upward direction. Restraining cable 78 prevents upward movement of pivotal arm 52 and pulley 48, thereby altering the path of the lift cable 44 by increasing the relative distance between pulleys 50 and 48, as illustrated in FIG. 4, to move a length of the cable over lift pulley 46, thereby lifting the pre-selected number of plates 40 vertically from the weight stack 36.

Figure 5:
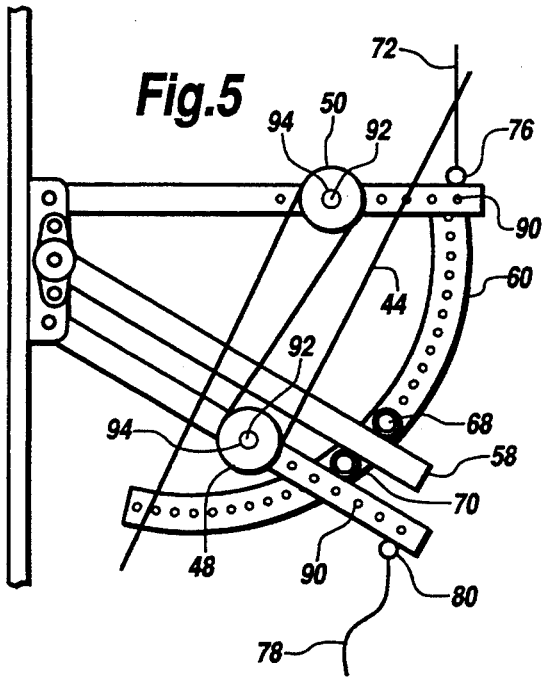
FIG. 5 is a side view similar to FIG. 3, illustrating downward movement of the lift bar.

Similarly, when the lift apparatus 22 is moved in a generally downward direction, the wheel member 70 rotatively contacts and forces pivotal arm 52 and resistance pulley 48 in a downward position, as illustrated in FIG. 5. Restraining cable 72 prevents downward movement of pivotal arm 54 to increase the relative distance between resistance pulleys 48 and 50, thereby altering the path of the lift cable 44 and moving a length thereof over lift pulley 46 to lift a pre-selected number of the plates 40 from weight stack 36. Thus, the combined configuration of the pivotal arms 52 and 54 and associated resistance pulleys 48 and 50 operating in conjunction with restraining cables 72 and 78 allow for smooth, bi-directional movement of the lift arm while maintaining a constant resistance on lift cable 44.

Figure 3:
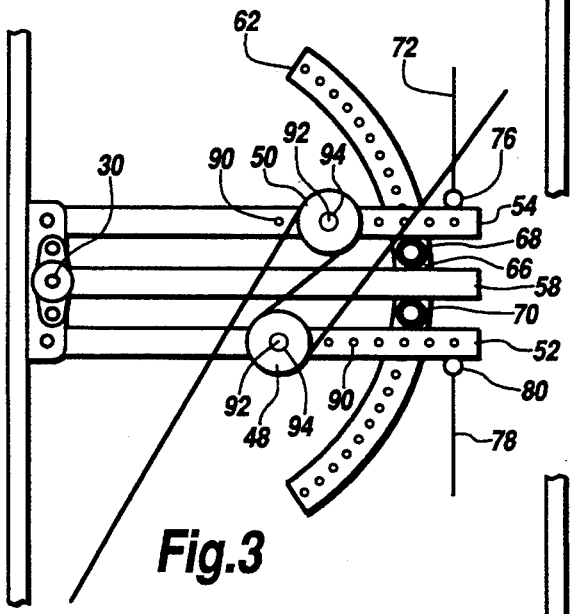
FIG. 3 is a side view of a lift bar adjustment and the lift cable resistance of the weight lifting machine of FIG. 1.

As shown in FIGS. 3, 4 and 5, pivotal arms 52 and 54 have apertures 90 at spaced apart intervals therein. Pins 92 pass through central passages 94 in restraining pulleys 48 and 50 for insertion into the apertures 90 to thereby adjust the position of resistance pulleys 50 and 48 to lower or increase the resistance applied to lift cable 44 by altering the position of pulleys 50 and 48 along pivotal arms 54 and 52, respectively.

Figure 7:
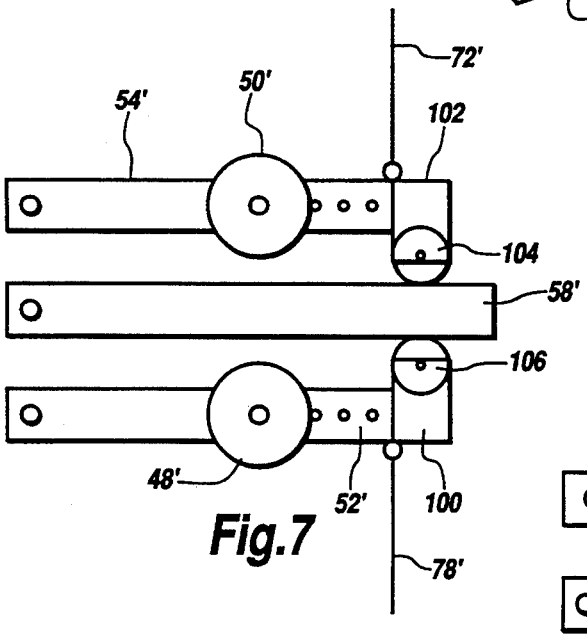
FIG. 7 is a side view of a cable resistance configuration incorporating a second embodiment of the cable resistance of the weight lifting machine of the present invention.

Referring now to FIG. 7, there is shown a pivotal arm configuration incorporating a second pivotal arm configuration embodiment of the weight lifting machine of the present invention. Many of the elements are similar to those of the pivotal arm configuration of the weight lifting machine 10 of FIGS. 1 and 3 and will be given the same reference numerals with the second embodiment pivotal arm configuration being differentiated by a prime "′" designation. The pivotal arm 52′ and 54′ have tabs 100 and 102, respectively, mounted to the distal ends thereof and extending toward the pivotal support arm 58′. Wheel members 104 and 106 are rotatably mounted on the tabs 100 and 102, respectively, for rotational movement along the surface of support arm 58 as support arm 58 is moved into upward contact with wheel member 104 and into downward contact with wheel member 106.

Figure 8:
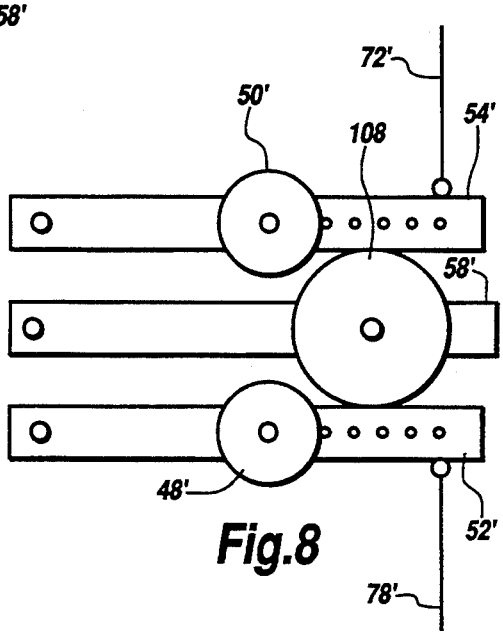
FIG. 8 is a side view of a cable resistance configuration incorporating a third embodiment of the cable resistance of the weight lifting machine of the present invention.

Referring now to FIG. 8, there is shown a pivotal arm configuration incorporating a third of the pivotal arm of the weight lifting machine of the present invention. Many of the elements are similar to those of the pivotal arm configuration of the weight lifting machine 10 of FIGS. 1 and 3 and will be given the same reference numerals with the third embodiment pivotal arm configuration being differentiated by a prime "′" designation. Pivotal support arm 58′ has a wheel member 108 rotatably mounted thereon and having a diameter substantially equal to the distance separating pivotal arm 54′ from pivotal arm 52′. Therefore, as pivotal support arm 58′ is moved in a generally upward direction, wheel member 108 contacts pivotal arm 54′ and rotates along the side of pivotal arm 54′ as pivotal arm 54′ is forced in a generally upward direction. Likewise, as pivotal support arm 58′ is moved in a generally downward direction, wheel number 108 contacts pivotal arm 52′ and rotates along pivotal arm 52′ as pivotal arm 52′ is forced in a generally downward direction. As with the weight lifting machine 10, the restraining cable 72′ limits downward pivotal movement of pivotal arm 54′, and restraining cable 78′ limits upward pivotal movement of pivotal arm 52′, thereby increasing the distance between pulleys 50′ and 48′ as pivotal support arm 58′ is moved in an upwardly or downwardly direction.

Figure 9:
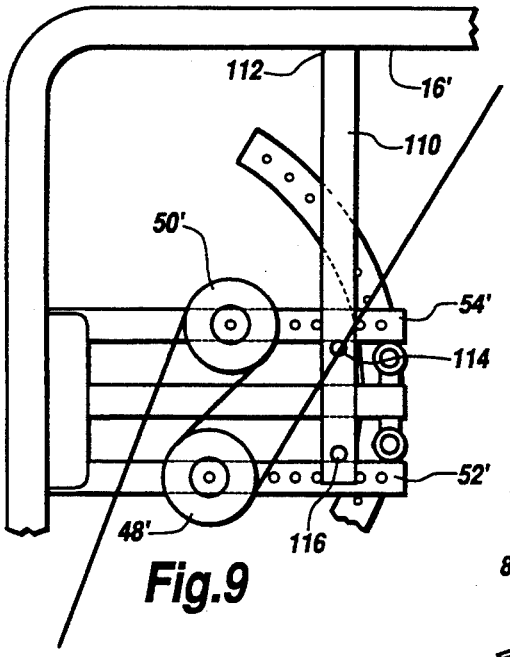
FIG. 9 is a side view of a cable resistance incorporating a fourth embodiment of the cable resistance of the weight lifting machine of the present invention.
Figure 6:
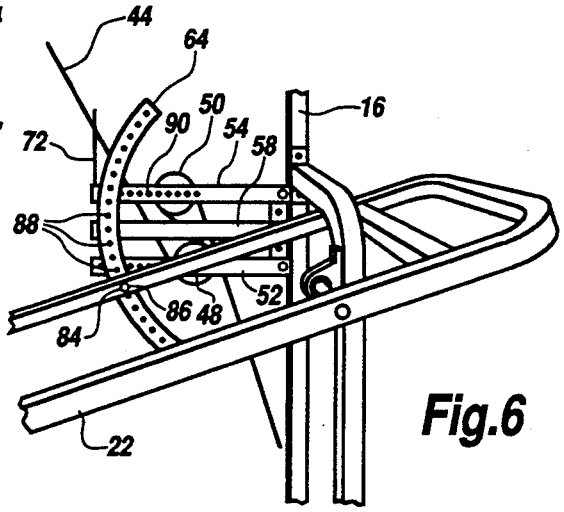
FIG. 6 is a side view of a portion of the lift bar and the cable resistance of the weight lifting machine of FIG. 1.

Referring now to FIG. 9, there is shown a pivotal arm configuration incorporating a fourth embodiment of the pivotal arm configuration of the weight lifting machine of the present invention. Many of the elements are similar to those of the pivotal arm configuration of the weight lifting machine 10 of FIGS. 1 and 3 and will be given the same reference numerals with the fourth embodiment pivotal arm configuration being differentiated by a prime "′" designation. A bar 110 is attached to the weight support frame 16′ at a point 112 above the pivotal arm 54′ and extends downwardly therefrom terminating at a point below the uppermost edge of pivotal arm 52′. Extending perpendicularly from the bar 110 is a stop peg 114 which contacts the lowermost surface of pivotal arm 54′ to restrict downward movement of pivotal arm 54′. A second stop peg 116 extends outwardly from the bar 110 for contacting the uppermost surface of pivotal arm 52′, to restrict upward movement of pivotal arm 52′. Thus, bar 110 and stop pegs 114 and 116 of FIG. 9 perform the same function of limiting pivotal movement as that performed by restraining cables 72 and 78 of FIG. 1.

Figure 10:
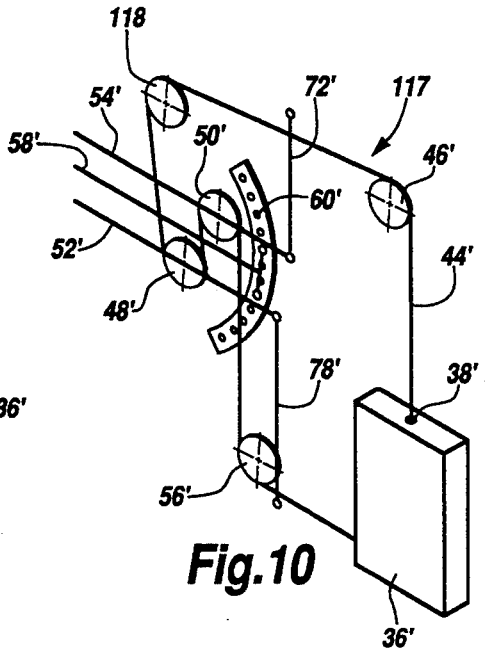
FIG. 10 is a schematic diagram of the cable path of a weight lifting machine incorporating a second embodiment cable path of the weight lifting machine of the present invention.

Referring now to FIG. 10, there is shown a schematic diagram of a pulley configuration 117 incorporating a second embodiment pulley configuration of the weight lifting machine of the present invention. Many of the elements are similar to those of the weight lifting machine 10 of FIG. 2 and will be given the same reference numerals with the second embodiment pulley configuration being differentiated by a prime ′ designation. The lift cable 44′ is attached at a first end to a selector rod 38′ of the weight stack 36′. The lift cable 44′ extends vertically from the weight stack 36′ and passes over a first lift pulley 46′, from where the path of the lift cable 44′ extends in a generally horizontal direction to pass over a second lift pulley 118 thereby distributing the lift stress prior to passing the lift cable 44′ around a first resistance pulley 48′ and over a second resistance pulley 50′. After passing over resistance pulley 50′, the lift cable 44′ extends in a generally vertical direction and passes under an anchor pulley 56′ and is attached to the weight support frame 16′ at some point beyond anchor pulley 56′.

The resistance pulleys 48′ and 50′ are mounted on pivotal arms 52′ and 54′, respectively, such that movement of apertured arc member 60′ moves pivotal support arm 58′, on which it is mounted, into contact with pivotal arm 54′ in the upward direction and into contact with pivotal arm 52′ in the downward direction to increase the distance between resistance pulleys 50′ and 48′, altering the path of the lift cable 44′, and thereby raising a preselected amount of weight.

Figure 11:
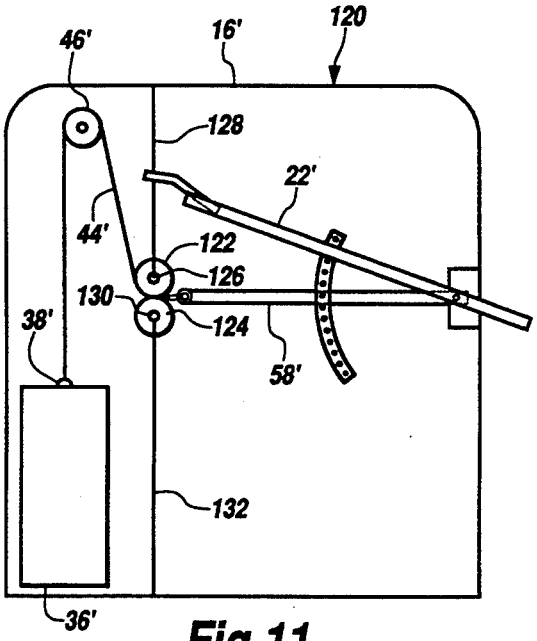
FIG. 11 is a schematic diagram of the cable path and cable resistance of a weight lifting machine incorporating a third embodiment cable path and a fifth embodiment cable resistance of the weight lifting machine of the present invention.
Figure 13:
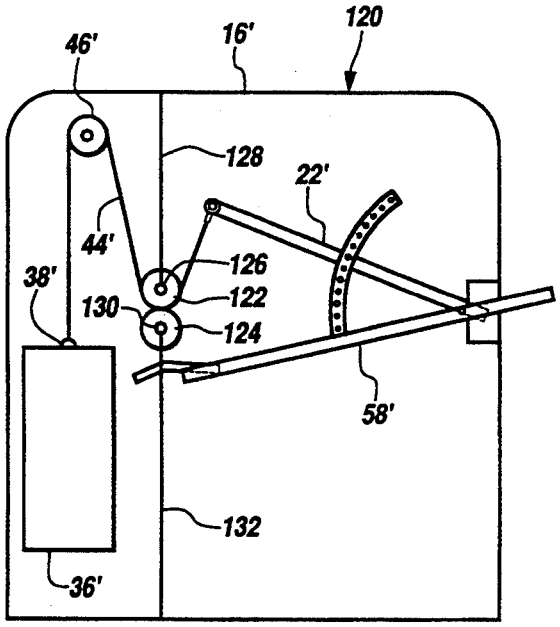
FIG. 13 is a view similar to FIG. 11, illustrating upward movement of the lift bar.
Figure 12:
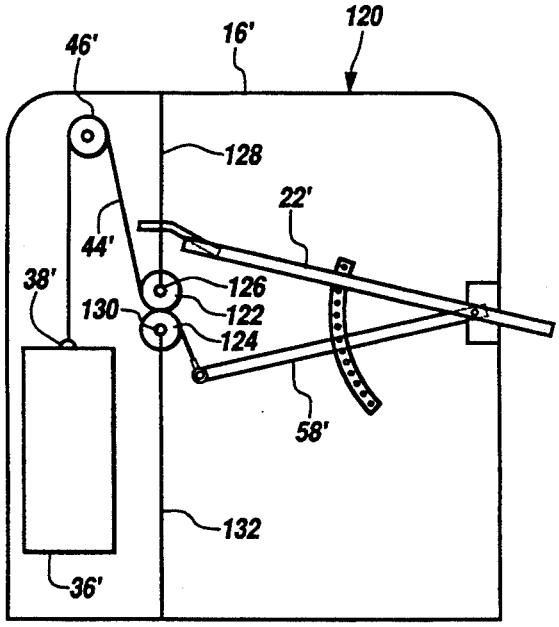
FIG. 12 is a view similar to FIG. 11 illustrating downward movement of the lift bar.

Referring now to FIGS. 11, 12, and 13, there is shown a schematic illustration of a pulley and cable configuration incorporating a third embodiment pulley configuration of the weight lifting machine of the present invention. Many of the elements are similar to those of the weight lifting machine 10 of FIG. 2 and will be given the same reference numerals with the third embodiment pulley configuration being differentiated by a prime "'" designation. The lift cable 44' is connected at one end to the selector rod 38' of the weight stack 36' and travels in a generally vertical direction to pass over lift pulley 46'. After passing over the lift pulley 46', the cable passes between resistance pulleys 122 and 124.

Resistance pulley 122 is rotatably mounted on the distal end 126 of a support arm 128 fixedly attached to the top of the weight support frame 16' and extending downwardly therefrom in a generally vertical direction. Resistance pulley 124 is likewise rotatably mounted on the distal end 130 of a support arm 132 fixedly attached to the bottom of the weight support frame 16' and extends upwardly therefrom in a generally vertical direction such that resistance pulley 124 is in vertical alignment with and adjacent to resistance pulley 122 near the distal end of the support arm 58' and between the distal end of the pivotal support arm 58' and the lift pulley 46'. The second end of the lift cable 44' is pivotally attached to the distal end of the pivotal support arm 58'. Thus, as the lift apparatus 22' is pulled downwardly, pivotal support arm 58' is forced downwardly such that lift cable 44' passes under resistance pulley 122 and over resistance pulley 124 to lift the preselected amount of weight. Likewise, when lift apparatus 22' is moved in an upward direction, forcing pivotal support arm 58' in a generally upward direction, lift cable 44' passes under and around resistance pulley 122, thereby lifting the preselected amount of weight.

Figure 14:
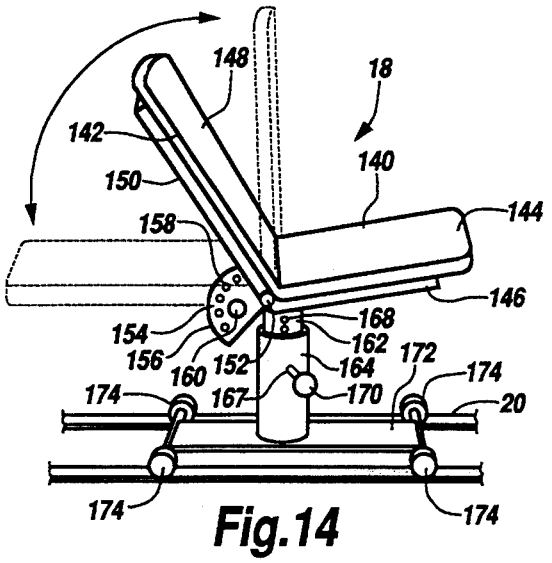
FIG. 14 is a side view of the bench of the weight lifting machine of FIG. 1, illustrating adjustable angular positioning of the bench back.

Referring now to FIG. 14, the bench 18 of the weight lifting machine 10 has a seat 140 and a back 142. The seat 140 has a cushion 144 and a base 146 on which the cushion 144 is mounted. Likewise, the back 142 has a cushion 148 mounted on a base 150. A portion of the seat base 146 extends rearwardly beyond the seat 140. The portion of the base 146 extending beyond the cushion 144 forms an adjustment member 152 having an aperture 154 therein. Mounted to the base 150 of the back 142 is a corresponding adjustment member 156 which extends outwardly from the base 150 of the back 142 adjacent to the adjustment member 152. A series of apertures 158 are arranged in an arcuate pattern along adjustment member 156 for positioning of any one of the apertures adjacent the aperture 154 in adjustment member 152 for receiving a pin 160 therethrough, thereby adjusting the position of the back 142 in angular relationship to the seat 140. Thus, the seat back 142 may be adjusted to any of a number of angles from substantially vertical to substantially horizontal, as illustrated in FIG. 14. Although, in the preferred embodiment of the invention the bench back is adjusted through use of the adjustment member 152, it is understood that a gear type adjustment 153, as illustrated in FIG. 1, may be substituted therefor.

Figure 15:
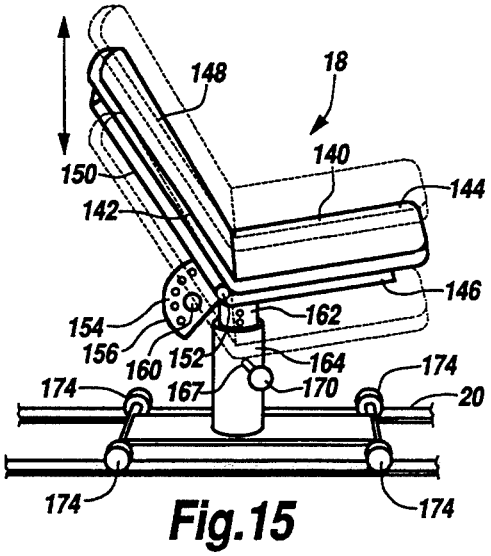
FIG. 15 is a side view of the bench of FIG. 1, illustrating vertical adjustment of the bench.
Figure 18:
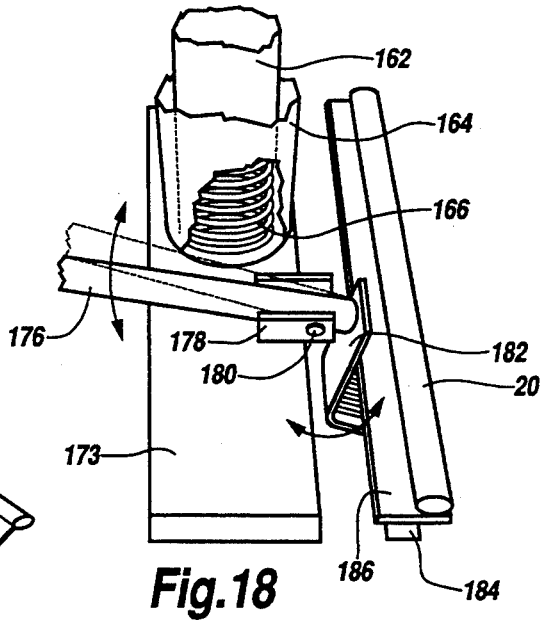
FIG. 18 is a partial front view of the base of FIG. 17 wherein the vertical adjustment and horizontal locking apparatus are shown in greater detail.

In addition to the angular adjustment of the bench back 142, the entire bench 18 may be adjusted vertically, as shown in FIG. 15, to obtain the height necessary to accommodate exercisers of all body types and sizes and for performing a variety of different exercises depending upon the angular adjustment of the lift apparatus of the weight lifting machine. The bench 18 is supported on a shaft 162 inserted within a cylinder 164 for vertical movement therein and is supported on a spring 166 within cylinder 164, as shown in FIG. 18. The shaft 162 has a plurality of apertures 168 extending in vertical alignment therein. Cylinder 164 has a corresponding aperture 167 therein for receiving a pin 170 which is inserted into one of the corresponding apertures 168 of shaft 162 to lock the vertical position of the bench 18. When the pin 170 is removed from the apertures 167 and 168, the spring 166 forces the shaft 162 upwardly, thereby raising the bench 18. Pressure is applied to the seat 140 of the bench 18, thereby compressing the spring 166 and lowering the bench 18. When the desired vertical position is achieved, the pin 170 is inserted into the aperture 167 in the cylinder 164 and the corresponding aperture 168 in the shaft.

Figure 16:
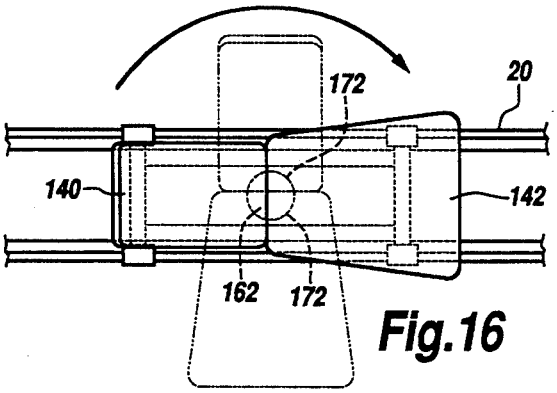
FIG. 16 is a top view of the bench of FIG. 1, illustrating rotational adjustment of the bench.

Referring now to FIG. 16, in addition to the apertures 168 in the shaft 162, there exist additional vertically extending rows of apertures 172 at spaced apart intervals around the circumference of the shaft 162. Thus, in addition to allowing the vertical movement of the bench 18, removal of the pin 170 allows vertical rotation of the shaft 162 within the cylinder 164, thereby allowing vertical rotation of the bench 18, as illustrated in FIG. 16.

Figure 17:
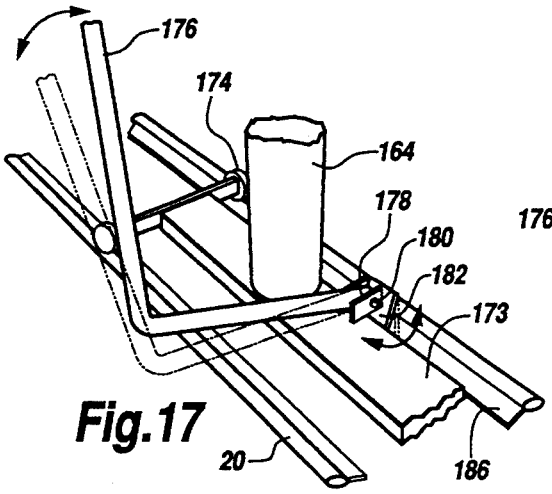
FIG. 17 is a partial oblique view of the base of the bench of FIG. 14, showing the locking mechanism for securing the horizontal position of the bench.

Referring now to FIGS. 17 and 18, the cylinder 164 of the bench 18 is mounted on a platform 173 having wheel members 174 mounted on opposed ends thereof for horizontal movement of the platform 173 over the bench track 20. A lever 176 is pivotally mounted in a bracket 178 fixedly attached to the platform 173. Mounted on the end of the lever 176 near the pivotal attachment point 180 of the lever 176 to the bracket 178 is the first half 182 of an interlocking rack bar. The second half 184 of the interlocking rack bar is mounted under a lip 186 of the bench track 20 and extends the length thereof. The first half 182 and second half 184 of the interlocking rack bar have corresponding surfaces of alternating peaks and valleys matingly connecting the first half 182 and second half 184 of the interlocking rack bar when the lever 176 is pivoted in a generally downward position, thereby bringing the first half 182 of the interlocking rack bar upwardly and in contact with the second half 184 of the interlocking rack bar. Thus, the corresponding peaks and valleys of the surfaces of the rack bar prevent horizontal movement of the platform 173 over the bench track 20. Similarly, movement of the lever 176 in a generally upward direction about pivot point pivotal attachment point 180 moves the first half 182 of the rack bar in a generally downward position, thereby disengaging the second half 184 of the rack bar to allow freedom of movement of the platform 173 over the track 20.

Figure 19:
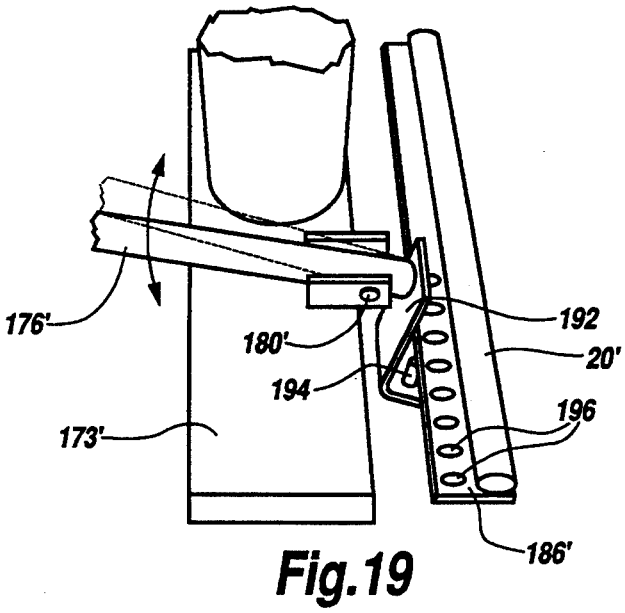
FIG. 19 is a view similar to FIG. 18 illustrating a second embodiment of the horizonal locking apparatus.

Referring now to FIG. 19, there is shown a second embodiment bench 190 of the weight lifting machine of the present invention. Many of the elements are similar to those of the weight lifting machine 10 of FIG. 18 and will be given the same reference numerals with the second embodiment bench being differentiated by a prime "'" designation. A flange 192 is mounted on the end of the lever 176' adjacent the pivotal attachment point 180' and extends under the lip 186' of the track 20'. A rod 194 is mounted on the flange 192 and extends in a generally upward direction. A series of apertures 196 extend the length of the lip 186' for receiving the rod 194 therein upon pivoting of the lever 176' in a generally downward position, thereby locking the platform 173' in position to prevent horizontal movement over the track 20'. Pivoting of the lever 176' in a generally upward direction moves the flange 192 in a generally downward direction thereby removing the rod 194 from the aperture 196 in the lip 186', freeing the platform 172' for horizontal movement along the track 20'.

Figure 20:
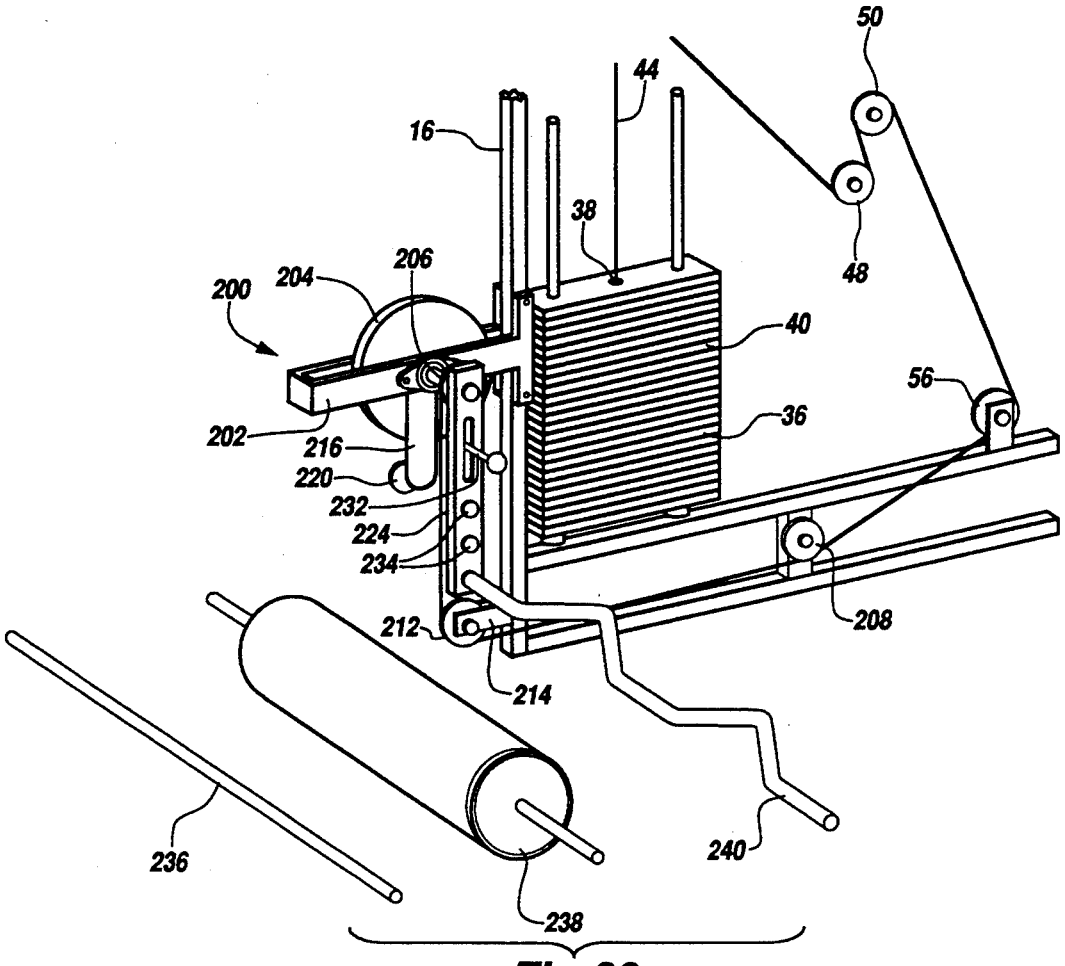
FIG. 20 is a side view of a portion of the weight lifting machine of FIG. 1 showing a second adjustable weight lifting apparatus attached to the frame of the weight lifting machine.

Referring now to FIG. 20, there is shown a second lift apparatus 200 having a U-shaped frame 202 for mounting the lift apparatus 200 on the weight support frame 16 of the weight lifting machine 10. A wheel member 204 is fixedly mounted on a shaft 206 extending through the U-shaped frame 202 such that the wheel member 204 rotates clockwise and counter-clockwise within the U-shaped frame 202.

Figure 24:
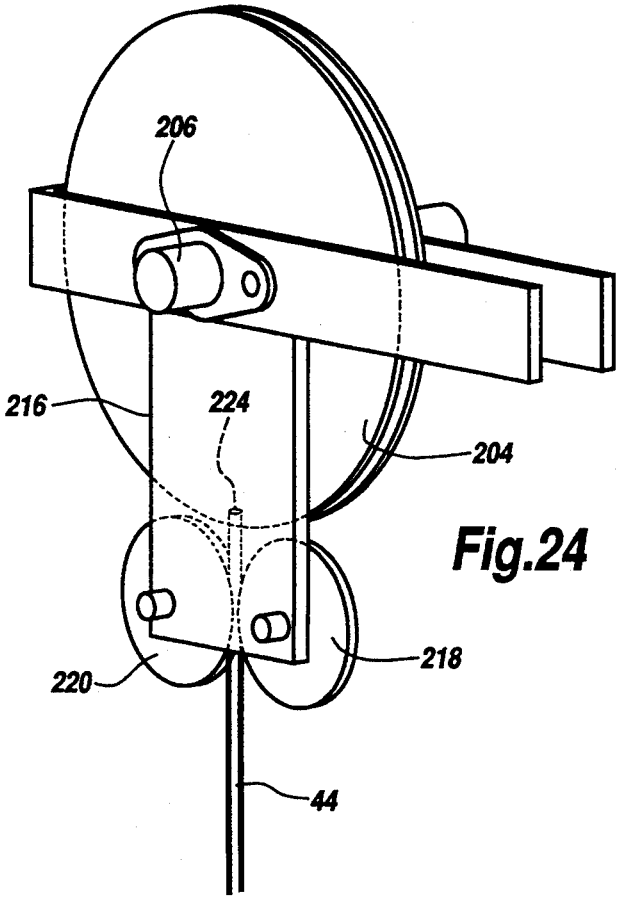
FIG. 24 is an enlarged view of a portion of the second weight lifting device of FIG. 20 showing lift cable attachment to the weight lifting device.

As illustrated in FIGS. 20 and 24, the lift cable 44 passes around the anchor pulley 56 and under a first guide pulley 208 mounted on the weight support frame 16 near the base frame 14. The lift cable 44 then passes through an opening 210 in the weight support frame 16 and around a second guide pulley 212 rotatably mounted on a support member 214 attached to the weight support frame 16 and extending substantially parallel to the U-shaped frame 202. After passing around the second guide pulley 212, the end of the lift cable 44 extends vertically upwardly from the pulley 212 and is pivotally connected to the wheel member 204 at pivot point 224.

Referring still to FIG. 24, a bracket 216 is mounted to the U-shaped support frame 202 adjacent the shaft 206 and extends downwardly therefrom and perpendicular to the U-shaped support frame 202. Rotatably mounted in the distal end of the bracket 216 are guide pulleys 218 and 220. Thus, as the wheel member 204 is rotated in a clockwise direction, lift cable 44 drawn over guide pulley 220, and as wheel member 204 is rotated in a counter-clockwise direction, lift cable 44 is drawn over guide pulley 218.

Figure 21:
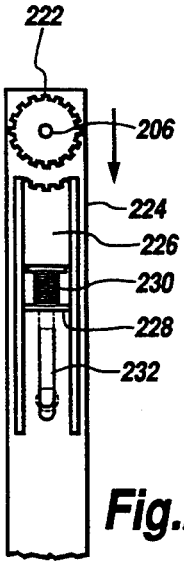
FIG. 21 is an enlarged view of the adjustment mechanism of the weight lifting apparatus of FIG. 20.
Figure 22:
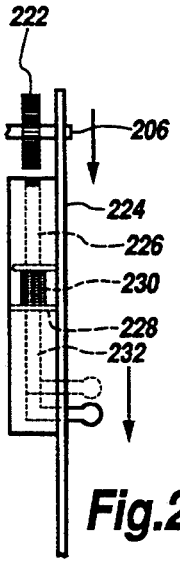
FIG. 22 is a side view of the adjustment mechanism of FIG. 21.

Referring now to FIGS. 20, 21 and 22, fixedly mounted to the shaft 206 is a gear 222 interposed between the U-shaped frame 202 and an adjustment frame 224. Mounted within the adjustment frame 224 is a tooth cleat 226 for engagement with the gear 222. Interposed between the cleat 226 and a block 228 is a spring 230 surrounding a lever 232 slidably extending through the block 228 and attached to the base of the cleat 226. When downward pressure is applied to the lever 232, the cleat 226 is forced downwardly, compressing the spring 230 and disengaging the gear 222. Once the cleat 226 and gear 222 are disengaged, the adjustable frame 224 can be rotated about the shaft 206 for angular positioning of the adjustable frame 224 in relation to the U-shaped frame 202. Once the desired angular position has been achieved, the downward pressure on the lever 232 is released allowing the spring 230 to expand forcing the cleat 226 into engagement with the gear 222 to lock the adjustable frame 224 in position.

Figure 23:
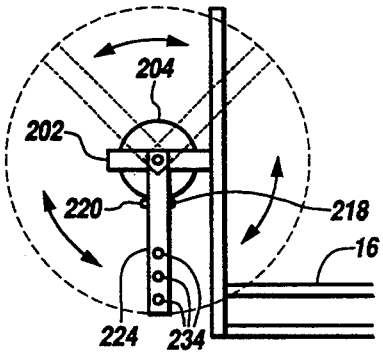
FIG. 23 is a schematic diagram showing the rotational movement of the weight lifting device of FIG. 20.

Referring still to FIG. 20, the adjustable frame 224 has apertures 234 therein for receiving a variety of weight lifting members therein, such as a bar 236, a padded roll 238, or a crooked bar 240. As the weight lifter applies force to the weight lifting member, in this instance the crooked bar 240, the adjustable frame 224 is rotated clockwise or counter-clockwise depending upon the direction of the force applied by the exerciser, as illustrated in FIG. 23. As the adjustable frame 224 rotates, the shaft 206 is rotated, in turn rotating the wheel member 204, thereby winding the lift cable 44 around the wheel member 204.

Referring now to FIGS. 20 and 23, as the lift cable 44 is wound about the wheel member 204, it is drawn near the guide pulleys 212 and 208, around the anchor pulley 56, over the resistance pulley 50, around the resistance pulley 48, and over the lift pulley 46, thereby raising the preselected number of plates 40 of the weight stack 36. Thus, with the addition of guide pulleys 208 and 212 and the attachment of the cable to wheel member 204, a single cable is used to lift plates 40 of the weight stack 36 through actuation of the first lift apparatus 22 as well as the second lift apparatus 200. The lift members 236, 238, and 240 may also be inserted into the opening 34 in the lift apparatus 22 to provide a variety of lifting surfaces for lift apparatus 22.

Figure 25:
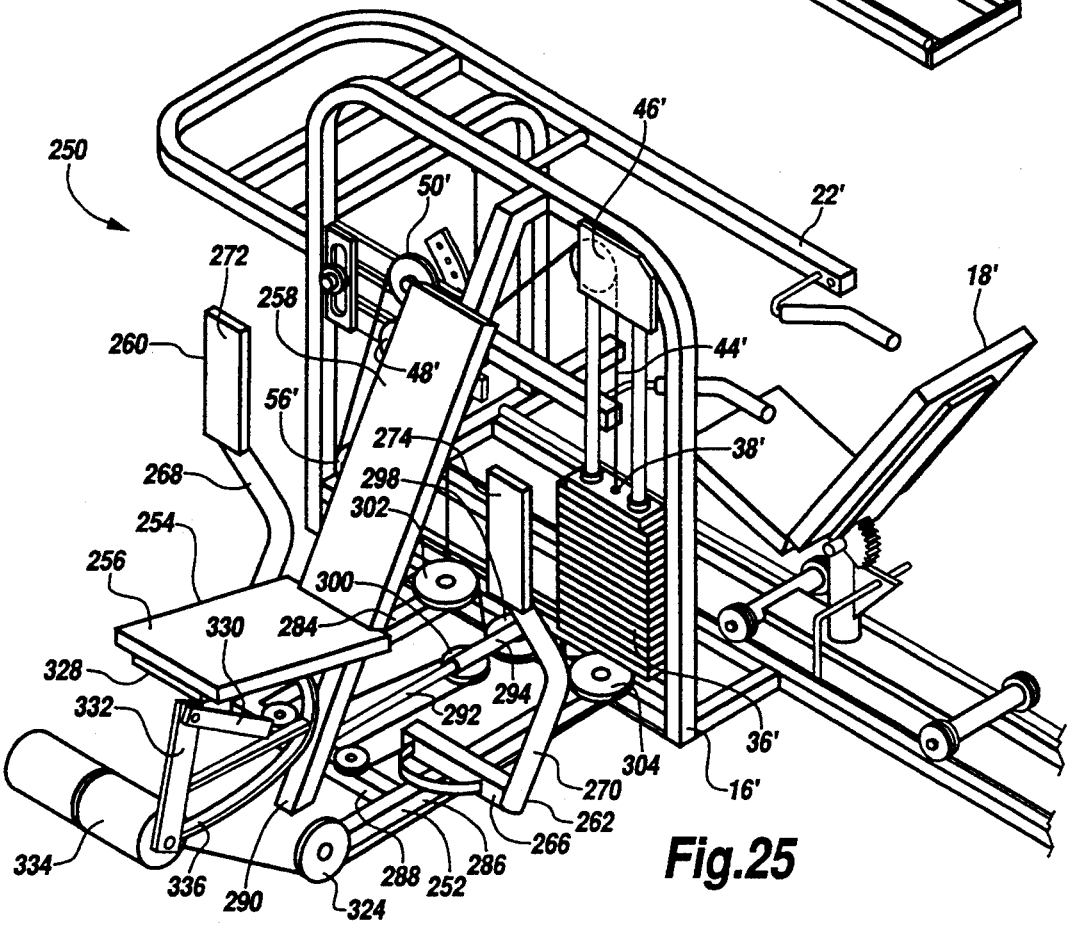
FIG. 25 is a multi-station weight lifting machine incorporating a second embodiment of the weight lifting machine of the present invention.
Figure 26:
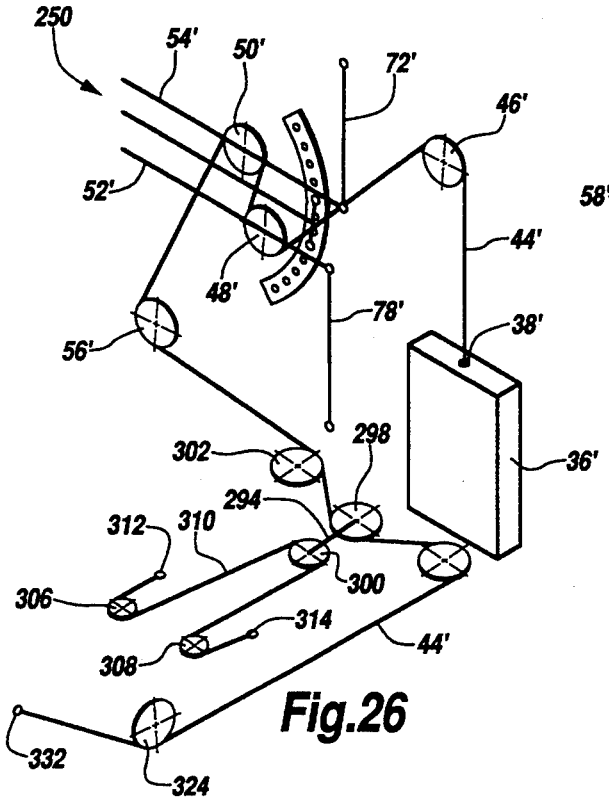
FIG. 26 is a schematic diagram of the lift cable configuration of the weight lifting machine of FIG. 25.
Figure 27:
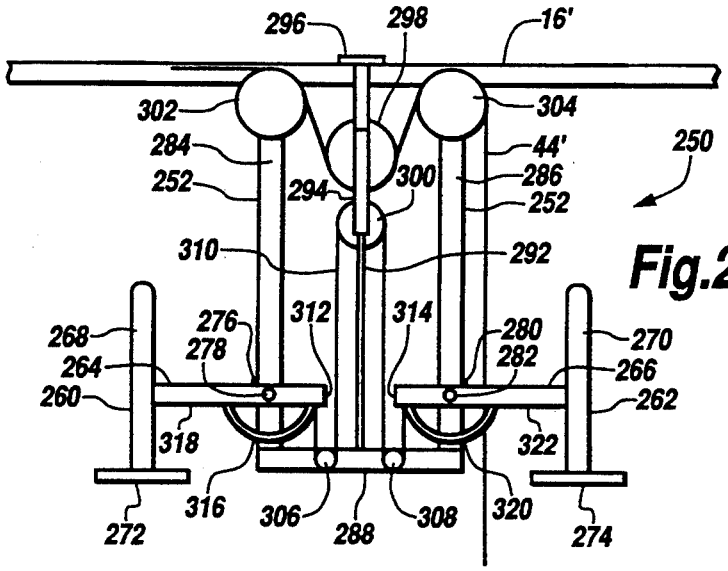
FIG. 27 is a partial top view of one station of the weight lifting machine of FIG. 25.

Referring now to FIGS. 25, 26, and 27, there is shown a dual station weight lifting machine 250 incorporating a second embodiment weight lifting machine of the present invention. Many of the elements are similar to those of the weight lifting machine 10 of FIG. 1 and will be given the same reference numerals with the second embodiment weight lifting machine being differentiated by a prime "'" designation. The weight lifting machine 250 has a second base frame 252 having a bench 254 mounted thereon. The bench 254 has a seat 256 and a back 258, which faces away from the weight support frame 16' and in a direction generally perpendicular to that of the bench 18'.

Pivotally mounted to the base frame 252 on one side of the bench 254 is a butterfly bar 260 which extends upwardly from the base frame 252 to a level approximately chest high of a person seated on the bench 254. A second butterfly bar 262 is pivotally mounted on the base frame 252 on the side of the bench 254 opposite the first butterfly bar 260. The butterfly bars 260 and 262 have bases 264 and 266, respectively, which are pivotally mounted on the base frame 252 and extend in a generally horizontal direction. Mounted on one end of bases 264 and 266 are curved bar members 268 and 270, respectively, which extend in a generally vertical direction upwardly from the bases 264 and 266. Extending upwardly from the crooked bar members 268 and 270 are padded extensions 272 and 274, respectively, and, when in a resting position, extending in a generally vertical direction and substantially parallel to the weight support frame 16'.

A stop 276 limits pivotal movement of base 264 of butterfly bar 260 about pivotal attachment point 278 in a direction toward the weight support frame 16'. A similar stop 280 limits pivotal movement of base 266 of butterfly arm 262 about pivotal attachment point 282 in a direction toward the weight support frame 16'. Thus, padded extensions 272 and 274 may be pushed forwardly and inwardly to the point of contacting one another but are limited in their return movement rearwardly by stops 276 and 280, respectively.

Base frame 252 has opposed side members 284 and 286 attached to the weight support frame 16' at spaced apart locations and extending perpendicularly outwardly therefrom. A transverse member 288 extends perpendicular to and is attached on opposed ends to side members 284 and 286 to form a generally U-shape extending outwardly from the weight support frame 16'. The bench 254 is supported on the transverse member 288 by shaft 290.

A rod 292 extends parallel to and between the side members 284 and 286 and is connected at one end to the weight support frame 16' and at the other end to transverse member 288 of the base frame 252. A carriage 294 is mounted surrounding the rod 292 for slidable movement along rod 292 between the weight support frame 16' and the transverse member 288 of the base frame 252. A stop 296 extends a short distance outwardly from the weight support frame 16' to restrict the movement of the carriage 294 over the rod 292 as it approaches the weight support frame 16'. Rotatably mounted to the underside of the carriage 294 and adjacent to one another are a resistance pulley 298 and a guide pulley 300.

A second resistance pulley 302 is rotatably mounted on top of side member 284 of base frame 252 at a point near the weight support frame 16'. Similarly mounted on top of side member 286 of base frame 252 is a third resistance pulley 304. Two small guide pulleys 306 and 308 are mounted on the top of transverse member 288 of the base frame 252 on opposed sides of shaft 290 supporting the bench 254. A cable 310 is connected at one end to the distal end 312 of base 264 of the butterfly bar 260 and is threaded around small pulley 306 from where it extends toward weight support frame 16' to pass around guide pulley 300. Cable 310 then travels away from weight support frame 16' to pass around small pulley 308 from where the second end extends for attachment to the distal end 314 of base 266 of butterfly bar 262.

Figure 28:
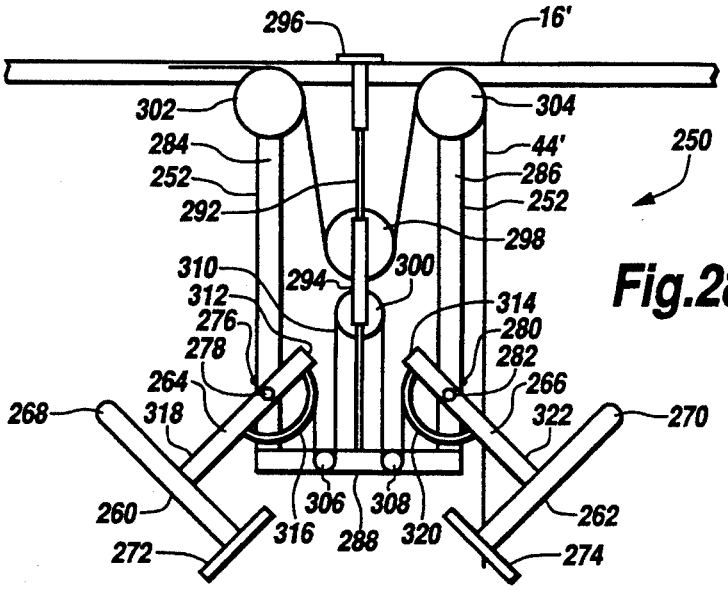
FIG. 28 is a view similar to FIG. 27 illustrating pivotal movement of butterfly bars of the weight lifting machine of FIG. 25.
Figure 29:
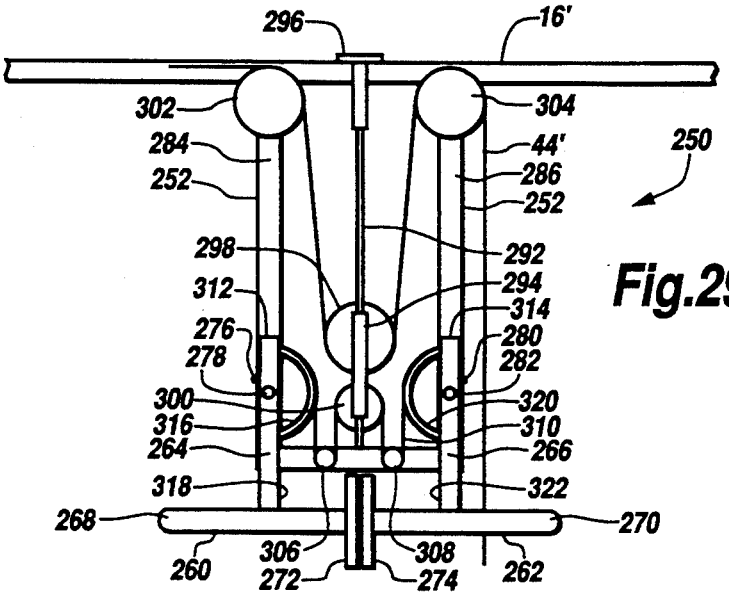
FIG. 29 is a view similar to FIG. 28 illustrating further movement of the butterfly bars.

An arcuate member 316 is mounted on the side 318 of base 264 facing outwardly from the weight support frame 16', near the distal end 312 of the base 264. A similar arcuate member 320 is mounted on the side 322 of base 266 facing outwardly from the weight support frame 16'. Thus, as the butterfly bars 260 and 262 are rotated forward, either together or singularly, the ends of the cable 310 are drawn around arcuate members 316 and 320 away from small pulleys 306 and 308, thereby drawing guide pulley 300 toward small pulleys 306 and 308, in turn moving carriage 294 along rod 292 toward transverse member 288 of the base frame 252, as illustrated in FIGS. 28 and 29.

Referring now to FIGS. 25, 26, and 27, the side member 286 of the base frame 252, extends beyond the transverse member 288 and has a guide pulley 324 mounted for rotation on the distal end 326 thereof. Mounted to the base 328 of the seat 256 of the bench 254 is a pivotal support frame 330. Pivotally attached to the support frame 330 is a pivotal extension arm 332 having a lift member 334 rotatably mounted thereon and extending substantially perpendicular to the pivotal extensions arm 332 and parallel to the transverse member 288. An arcuate member 336 is attached to the pivotal extension arm 332 such that the outer curve of the arc faces toward the weight support frame 16'.

As in the weight lifting machine 10 of FIG. 1, the first end of the lift cable 44' is attached to the selector rod 38' of the weight stack 36'. The cable path for the weight lifting machine 250 is the same as that for weight lifting machine 10 of FIG. 1 to the point of the anchor pulley 56'. From that point, as clearly shown in FIGS. 25, 26, and 27, the lift cable 44' passes around the side of resistance pulley 302 nearest the weight support frame 16', and from there is threaded around the side of resistance pulley 298 away from the weight support frame 16'. Lift cable 44' then passes around the side of resistance pulley 304 nearest weight support frame 16' and extends horizontally away from resistance pulley 304 and the weight support frame 16' to pass under guide pulley 324 and upwardly to the pivotal extension arm 332 for attachment thereto at a point near the attachment point of lift member 334 to pivotal extension arm 332. As lift member 334 is lifted upwardly and outwardly from the starting position as shown in FIG. 25, the lift cable 44' is drawn around arcuate member 336 thereby lifting a selected number of plates 40' of the weight stack 36'.

Referring now to FIGS. 25, 26, 28, and 29, attachment of the lift cable 44' to the pivotal extension arm 332 provides a fixed attachment point for the second end of the lift cable 44' when using the butterfly bars 260 and 262. Thus, as the butterfly bars 260 and 262 are pivoted forward to draw carriage 294 toward transverse member 288 of base frame 252, resistance pulley 298 is likewise drawn toward transverse member 288, thereby drawing lift cable 44' over and around resistance pulley 302, anchor pulley 56', resistance pulleys 48' and 50', and lift pulley 46' to lift a preselected number of the plates 40' of the weight stack 36'.

The restraining cables 72' and 78' prevent pivotal movement of the pivotal arms 52' and 54' such that constant resistance is maintained on lift cable 44' as the butterfly bars 260 and 262 are pivoted forwardly and inwardly. Thus, the pulley and cable configuration of the weight lifting machine 250 of FIG. 25 allows the lifting of weight through the use of a single lift cable 44' by actuation of the first lift apparatus 22', the butterfly bars 260 and 262, and lift member 334. The use of a single cable to lift the weights by actuation from any one of the exercise stations facilitates easy maintenance and repair of the weight lifting machine.

Figure 30:
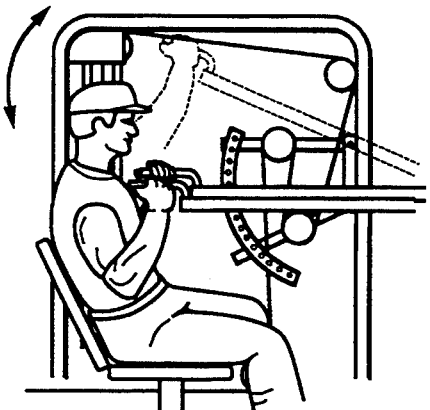
FIG. 30 is an illustration of the exercise known as shoulder or military press or pull down, using the weight lifting machine of FIGS. 1 and 25.
Figure 31:
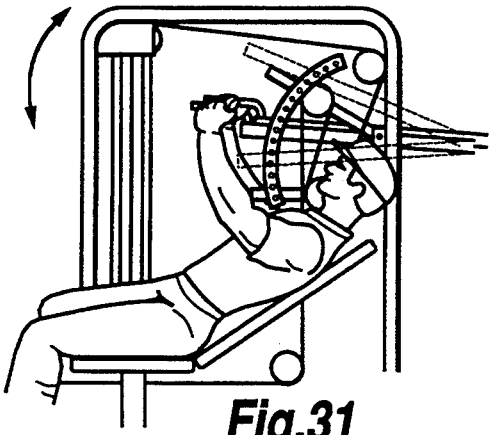
FIG. 31 is an illustration of the exercise known as incline press, using the weight lifting machine of FIGS. 1 and 25.
Figure 32:
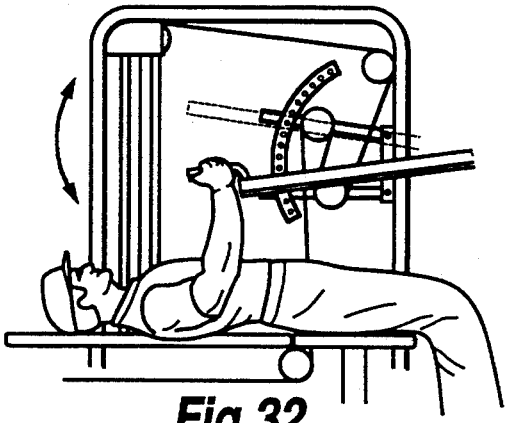
FIG. 32 is an illustration of the exercise known as bench press, using the weight lifting machine of FIGS. 1 and 25.

Referring now to FIGS. 30 through 41, there is illustrated a variety of exercises which can be performed using the weight lifting machines 10 and 250 and the second lift apparatus 200 of weight lifting machine 10. As illustrated in FIG. 30, the exerciser may rotate the bench 18 to face the lift apparatus 22 to performing an upwardly lifting exercise generally known as military press or pull down. As shown in FIG. 1, the exerciser may rotate the bench 18 and adjust the incline of the back 142 of the bench 18 to perform an exercise generally known as incline bench press. An alternative version of the bench press may be performed by adjusting the back 142 of the bench 18 to a full horizontal position with the bench rotated to face the lift apparatus 22.

Figure 33:
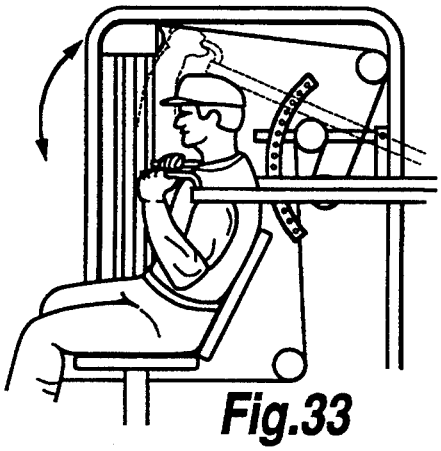
FIG. 33 is an illustration of the exercise known as shoulder press or pull down, using the weight lifting machine of FIGS. 1 and 25.
Figure 34:
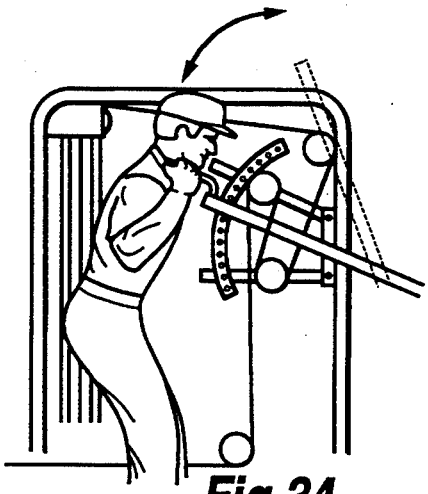
FIG. 34 is an illustration of the exercise known as squat, using the weight lifting machine of FIGS. 1 and 25.

As shown in FIG. 33, the bench may be positioned at an incline similar to that shown in FIG. 30, but rotated 180° which puts the exerciser facing away from the lift apparatus 22 to perform an exercise generally known as a military press.

Squats may be performed using the weight lifting machines 10 and 250 of the present invention by moving the bench 18 along the track 20 to a position away from the lift apparatus 22. The exerciser then stands adjacent to the lift apparatus 22 to perform an exercise fairly known as squats whereby the lift apparatus 22 is pulled in a downward position, or may perform a standing military press, whereby the lift apparatus 22 is moved in an upward position.

Figure 35:
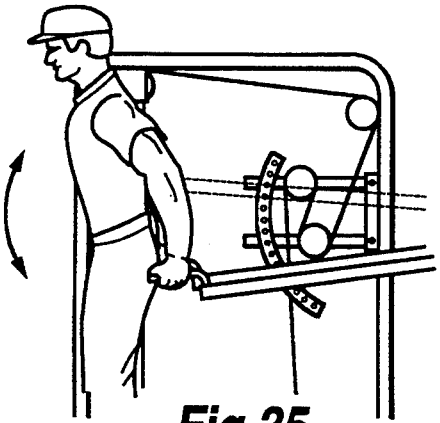
FIG. 35 is an illustration of the exercise known as tricep extension or rowing, using the weight lifting machine of FIGS. 1 and 25.
Figure 36:
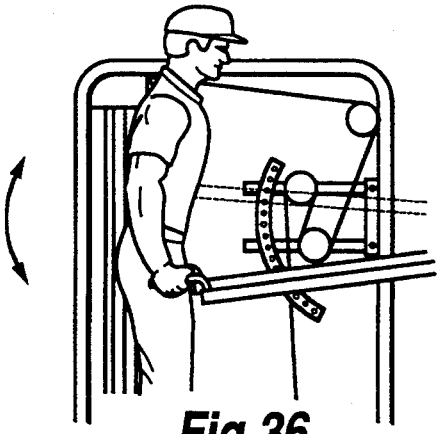
FIG. 36 is an Illustration of the exercise known as tricep extension or rowing using the weight lifting machine of FIGS. 1 and 25.

Referring now to FIGS. 35 and 36, with the bench 18 positioned on track 20 away from the lift apparatus 22, the exerciser may face away from the lift apparatus 22 to perform an exercise known as tricep extension or dips, and rowing, or may face the lift apparatus 22 to perform an exercise generally known as curls, whereby the lift apparatus 22 is raised from a downwardly extended arm position to a bent elbow chest height position.

Figure 37:
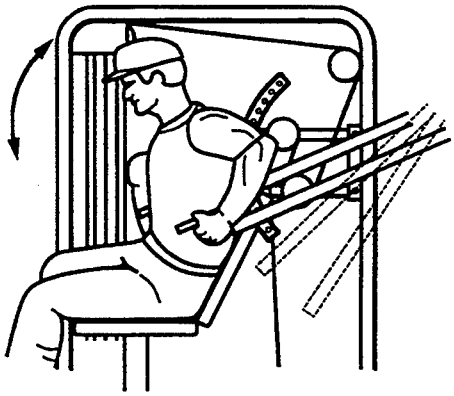
FIG. 37 is an illustration of the exercise known as seated tricep extension or rowing, using the weight lifting machine of FIGS. 1 and 25.
Figure 38:
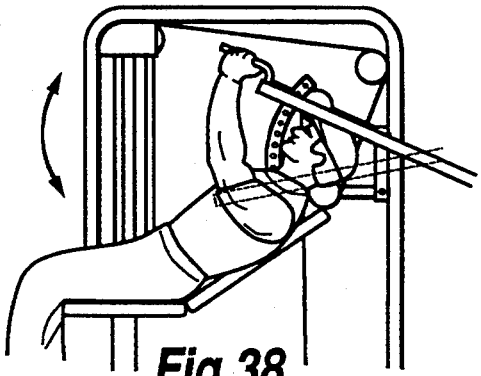
FIG. 38 is an illustration of the exercise known as incline bench press and incline lat pull, using the weight lifting machine of FIGS. 1 and 25.

Referring now to FIGS. 37 and 38, exercise is generally known as tricep extensions or dips and rowing, respectively, and performed by positioning the bench 18 to face away from the lift apparatus 22, adjusting the angle of the lift apparatus 22 in relation to the apertured arc member 60, and by adjusting the incline of the back 142 of the bench 18 to accomplish the desired exercise.

Figure 39:
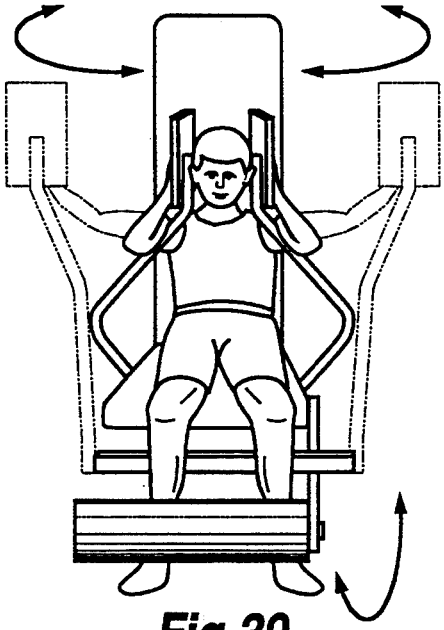
FIG. 39 is an illustration of the exercises known as butterflies and leg extensions, using the weight lifting machine of FIG. 25.
Figure 40:
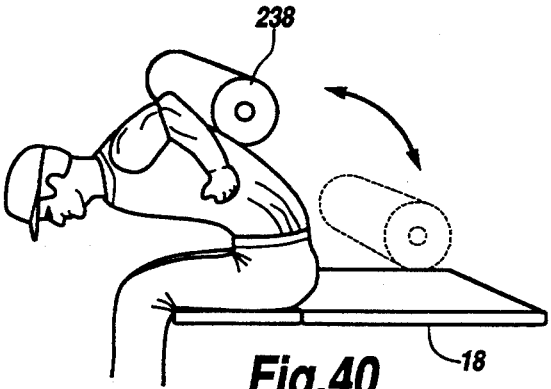
FIG. 40 is an illustration of the exercise known as back extension, using the weight lifting machine of FIG. 20.
Figure 41:
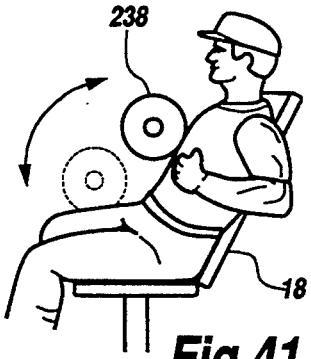
FIG. 41 is an illustration of the exercise known as stomach crunch, using the weight lifting machine of FIG. 20.

Referring now to FIG. 39, an exercise generally known as butterflies may be performed using the weight lifting machine 250, as well as an exercise known as leg extensions using the lift member 334. Leg extensions and leg curls may also be performed using the attachable second lift apparatus 200 by positioning the bench 18 such that the adjustable frame 224 extends downwardly in front of the seat 140 of the bench 18. The padded roll 238 is mounted in one of the apertures 234 in the adjustable frame 224 such that extension of the exerciser's legs outwardly from the bench 18 pivots the adjustable frame 224, thereby pivoting the shaft 206, in turn rotating the wheel member 204 to draw the lift cable 44 over the wheel member 204 thereby lifting the plates 40 from the weight stack 36. The lift apparatus 200 may also be used to perform any variety of lifting exercises using the bars 236 and 240, as well as to perform exercises generally known as crunches and illustrated in FIGS. 40 and 41 using the padded roll 238. Thus, as illustrated, a variety of exercises may be performed to conduct a total body workout on the weight lifting machines 10 and 250 utilizing a single lift cable 44 and a single weight stack 36 to accomplish all of the exercises while maintaining consistent resistance on the single lift cable 44.

Although preferred embodiments of the present invention have been illustrated in the accompanying Drawings and described in the foregoing Detailed Description, it is to be understood that the same is by way of illustration and example only and is not to be taken by way of limitation, the spirit and scope of the invention being limited only to the terms of the appended claims.

I claim:

1. A weight lifting machine, comprising:

a support frame;

an adjustable weight stack having a multiplicity of separate plates mounted on the support frame for vertical movement of a selected number of plates;

first lift means pivotally attached to the support frame for pivotal movement in a first direction and a second opposite direction;

a first member mounted to the support frame for movement in the first direction;

a first pulley rotatably mounted to the first member;

a second member mounted to the support frame for movement in the second opposite direction;

a second pulley rotatably mounted to the second member;

a first lift cable having a first end connected to the weight stack and a second fixed end, the first lift cable threaded around the first and second pulleys;

means for moving the first member in the first direction in response to movement of the first lift means in the first direction and for moving the second member in the second opposite direction in response to movement of the first lift means in the second opposite direction;

means for preventing movement of the first member in the second opposite direction when the second member is moved in the second opposite direction in response to movement of the first lift means in the second opposite direction;

means for preventing movement of the second member in the first direction when the first member is moved in the first direction in response to movement of the first lift means in the first direction; and movement of either the first member or the second member lengthening the distance between the first and second pulleys and thereby actuating the first lift cable to lift the selected number of plates.

2. The weight lifting machine of claim 1, further comprising a bench vertically adjustable and slidably mounted on the support frame for horizontal movement beneath the first lift means.

3. The weight lifting machine of claim 2, wherein the bench further comprises a seat portion and a back portion with the back portion being angularly adjustable.

4. The weight lifting machine of claim 3, wherein the bench seat portion is rotatably mounted for adjustable positioning about a vertically extending axis.

5. The weight lifting machine of claim 1, further including angular adjustment means whereby the first lift means is angularly adjustable upwardly and downwardly from a substantially horizontally extending position.

6. The weight lifting machine of claim 1, further comprising:

a second lift means pivotally attached to the support frame;

a third pulley through which the first lift cable is threaded;

a fourth pulley;

means for connecting the third pulley to the fourth pulley to translate the third pulley in response to translation of the fourth pulley, the translation of the third pulley actuating the first lift cable to lift the selected number of plates; and a second lift cable having at least one end connected to the second lift means, the second lift cable threaded around the fourth pulley, movement of the second lift means pulling the second lift cable and causing translation of the fourth pulley.

7. The weight lifting machine of claim 6, further comprising a third lift means pivotally attached to the support frame for connection of the second end of the first lift cable to the third lift means, movement of the third lift means actuating the first lift cable to lift the selected number of plates.

8. The weight lifting machine of claim 1, wherein the first lift means further comprises means for adjustably positioning the lift angle of the first lift means through an arcuate range of connection points.

9. The weight lifting machine of claim 1, wherein the first direction is upward and the second opposite direction is downward.

10. The weight lifting machine of claim 1, wherein the first lift cable is threaded around the first and second pulleys such that pulling an end of the first lift cable causes the first pulley to rotate in a direction opposite from a direction of rotation of the second pulley.

11. The weight lifting machine of claim 1, wherein the means for moving the first and second members comprises:

a third member mounted to the support frame for movement in the first direction and the second opposite direction;

means for connecting the first lift means to the third member;

a first wheel mounted to the third member and positioned adjacent to the first member to move the first member in the first direction in response to movement of the first lift means in a first direction; and a second wheel mounted to the third member and positioned adjacent to the second member to move the second member in the second opposite direction in response to movement of the first lift means in a second opposite direction.

12. The weight lifting machine of claim 1, wherein the means for moving the first and second members comprises:

a third member mounted to the support frame for movement in the first direction and the second opposite direction;

means for connecting the first lift means to the third member;

a first tab mounted to the first member and positioned adjacent to the third member to move the first member in the first direction in response to movement of the first lift means in the first direction; and a second tab mounted to the second member and positioned adjacent to the third member to move the second member in the second opposite direction in response to movement of the first lift means in the second opposite direction.

13. The weight lifting machine of claim 1, wherein the means for moving the first and second members comprises:

a third member mounted to the support frame for movement in the first direction and the second opposite direction;

means for connecting the first lift means to the third member; and a wheel mounted to the third member and positioned adjacent to the first and second members to move the first member in the first direction in response to movement of the first lift means in the first direction and to move the second member in the second opposite direction in response to movement of the first lift means in the second opposite direction.

14. The weight lifting machine of claim 1, wherein the means for preventing movement of the first and second members comprises:

a first restraining line having a first end connected to the support frame and having a second end connected to the first member to prevent movement of the first member in the second opposite direction; and a second restraining line having a first end connected to the support frame and having a second end connected to the second member to prevent movement of the second member in the first direction.

15. The weight lifting machine of claim 1, wherein the means for preventing movement of the first and second members comprises:

a bar having an end fixed to the support frame;

a first stop mounted to the bar to prevent movement of the first member in the second opposite direction; and a second stop mounted to the bar to prevent movement of the second member in the first direction.

16. An exercise apparatus comprising:

a press bar;

means for supporting the press bar for movement upwardly and downwardly;

an actuating bar;

means for connecting the actuating bar to the press bar for movement therewith;

means for selectively varying the positioning of the actuating bar relative to the press bar;

first and second pulleys mounted above and below the actuating bar, respectively;

means for moving the first pulley upwardly with the actuating bar when the press bar is moved upwardly;

means for moving the second pulley downwardly with the actuating bar when the press bar is moved downwardly;

means for limiting downward movement of the first pulley when the second pulley is moved downwardly;

means for limiting upward movement of the second pulley when the first pulley is moved upwardly;

a continuous cable trained around the first and second pulleys;

means for securing one end of the cable against movement, and resistance means connected to the other end of the cable for resisting movement of the press bar.

* * * * *